United States Patent [19]

Okada

[11] Patent Number: 4,575,388

[45] Date of Patent: Mar. 11, 1986

[54] PROCESS FOR RECOVERING ARGON

[75] Inventor: Hidetake Okada, Yokosuka, Japan

[73] Assignee: Nihon Sanso Kabushiki Kaisha, Japan

[21] Appl. No.: 578,200

[22] Filed: Feb. 8, 1984

[30] Foreign Application Priority Data

Feb. 15, 1983 [JP] Japan ..... 58-23428

[51] Int. Cl.[4] ..... F25J 3/04

[52] U.S. Cl. ..... 62/22; 62/30; 62/31; 62/34

[58] Field of Search ..... 62/22, 30, 31, 34, 24, 62/29

[56] References Cited

U.S. PATENT DOCUMENTS 4,384,876 5/1983 Mori et al. ..... 62/22

*Primary Examiner*—Frank Sever

*Attorney, Agent, or Firm*—Darby & Darby

[57] ABSTRACT

A process for recovering argon in which a crude argon column is supplied with an argon feed gas containing a larger proportion of oxygen from a double rectifier and is cooled at its head portion with or without liquid air from a sump of the lower column of the double rectifier for producing a reflux of argon in the crude argon column. In the process, argon gas is compressed to a pressure sufficient for evaporating liquid oxygen fed from a condenser of the double rectifier, is then precooled in a heat exchanger, and thereafter liquefied by heat exchange with the liquid oxygen. Then the head portion of the crude argon column is cooled with the liquefied argon, which is then returned in a gaseous state for further compression to thereby circulate the argon gas.

3 Claims, 4 Drawing Figures

PROCESS FOR RECOVERING ARGON

BACKGROUND OF THE INVENTION

The present invention relates to a process for recovering argon, and more particularly to an economical process for improving the yield of argon with relatively low consumption of electric power.

In the widely adopted process for recovering argon as shown in FIG. 1, argon-rich oxygen or argon feed gas is extracted from the middle stage of an upper column 4 of a double rectification column 2 of an air separation plant through a conduit 6 and then introduced into a crude argon column 8, where it is cooled and rectified with a liquefied air which is fed from the sump of a lower column 10 via conduits 11 and 12 and a heat exchanger 14, where the liquefied air is sujected to heat exchange with nitrogen gas led from the head of the upper column 4 via conduit 16, heat exchanger 28 and conduit 18. As a result, crude argon issues from the head of the argon column 8 through a conduit 20, and is sent to an argon purifying process (not shown) including a deoxidation unit and a high purity argon column where high purity argon is recovered. On the other hand, the liquefied air fed to a condenser 22 of the argon column 8 is evaporated in that condenser 22 and then passed through a conduit 24 into an upper column 4. Liquified oxygen issues through a conduit 26 from a sump of the argon column 8, and returns to the upper column 4. From the head of the upper column 4 there issues nitrogen gas, which is cooled by liquid nitrogen led through a conduit 17 from the head of the lower column 10 at a heat exchanger 28, and which then passes through conduit 18, heat exchanger 14 and conduit 30, into a heat exchanger 32 where compressed air is cooled by heat exchange with the nitrogen gas and then introduced into the bottom portion of the lower column 10 through a conduit 31.

In recovering argon by means of the air separation plant according to the above-mentioned air rectification process, it is, as described above, a common practice to cool the condenser 22 of the crude argon column 8 by heat exchange with part of the liquid air from the sump of the lower column 10 although the total amount of the liquid air should be supplied in a liquid state to the upper column 4 via a conduit 34. Therefore, in order to enhance the yield of crude argon in the crude argon column 8, it is naturally necessary to increase the amount of liquid air fed from the sump of the lower column 10 via conduit 11, heat exchanger 14 and conduit 12 for cooling the condenser 22, with the result that the supply of the liquid air to the upper column 4 is decreased. Consequently, the rectification performance of the upper column 4 is adversely affected to the point where, in the worst case, no argon feed can be obtained. Thus, the prior art process has an upper limit in the yield of argon. Particularly, in the overall low pressure air separation plant as shown in FIG. 1, output gaseous air of an expansion turbine 36 for generating make-up refrigeration is introduced into the upper column 4 and this air from turbine 36 deteriorates the conditions of rectification, so that the recovery of argon becomes difficult. Furthermore, in an air separation plant of a type that includes recovery of liquid nitrogen, a larger amount of the turbine air is necessary for recovering nitrogen in a liquid state, resulting in deterioration of the rectification conditions. Thus, in such prior art air separation plants a larger proportion of argon contained in the air feed from conduit 31 must be discharged together with nitrogen through conduit 40.

In order to overcome such a drawback, there is a well-known process involving the nitrogen cycle in which the nitrogen gas from the head of the upper column 4 is compressed to a pressure in the lower column 10 and then supplied to the latter after cooling or liquefaction thereof to restore the normal conditions of the rectification in the upper column 4 to thereby enhance the yield of argon. This process is more specifically illustrated in FIG. 2. The nitrogen gas from the head of the upper column 4 is passed via a conduit 42 to a heat exchanger 44 for heating it to around normal temperatures, and then introduced through a conduit 46 into a compressor 48 where it is compressed to a pressure of 4.8 kg/cm$^2$G. After the compressed nitrogen gas is cooled to −173° C. at the heat exchanger 44 by heat exchange with the low temperature nitrogen gas from the conduit 42, it is introduced through a conduit 50 to the upper part of the lower column 10, so that liquid nitrogen, which is introduced from the head of lower column 10 through conduit 17 into upper column 4, increases. This increase in the amount of the reflux restores good rectification conditions in the upper column. Although this process with the nitrogen cycle can improve the rectification conditions in the upper column 4, it requires a considerable amount of electric power for compressing the nitrogen gas from atmospheres pressure to a pressure of about 5 atmosphere in the lower column 10. Furthermore, the use of nitrogen gas, which has a small latent heat when liquefied, makes the amount of the nitrogen gas to be cycled larger. This fact further increases the necessary electric power.

SUMMARY OF THE INVENTION

Accordingly, it is an object of the present invention to provide a process for recovering argon in which argon is recovered at a high yield with a relatively low consumption of electric power and without deteriorating the rectification conditions in the upper column.

Another object of the present invention is to provide a process for recovering argon which can be applied to already-built argon recovering plants with a simple modification to thereby enhance their capacity of producing argon.

With these and other objects in view the present invention will provide a process for recovering argon in which a crude argon column is supplied with an argon feed gas containing a larger proportion of oxygen from a double rectifier and is cooled at its head portion with or without liquid air from a sump of the lower column of the double rectifier for producing a reflux of argon in the crude argon column. In the process, argon gas is compressed to a pressure sufficient for evaporating liquid oxygen fed from a condenser of the double rectifier, is then precooled in a heat exchanger, and thereafter liquefied by heat exchange with the liquid oxygen. Then the head portion of the crude argon column is cooled with the liquefied argon, which is then returned in a gaseous state for further compression to thereby circulate the argon gas.

DETAILED DESCRIPTION OF THE PREFERRED EMBODIMENTS

Figure 2:
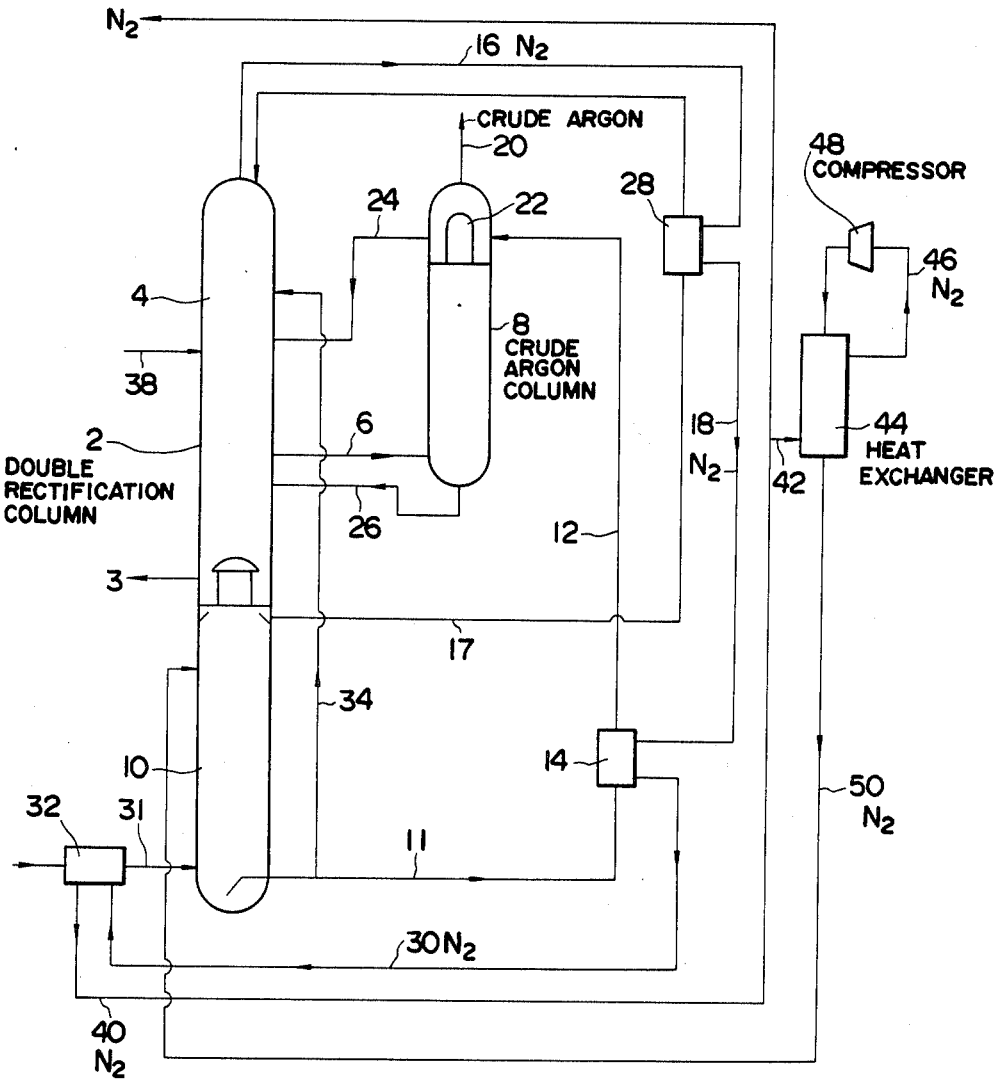
FIG. 2 PRIOR ART
FIG. 2 is a flowsheet of another typical example of the prior art argon recovering system with the nitrogen cycle.
Figure 3:
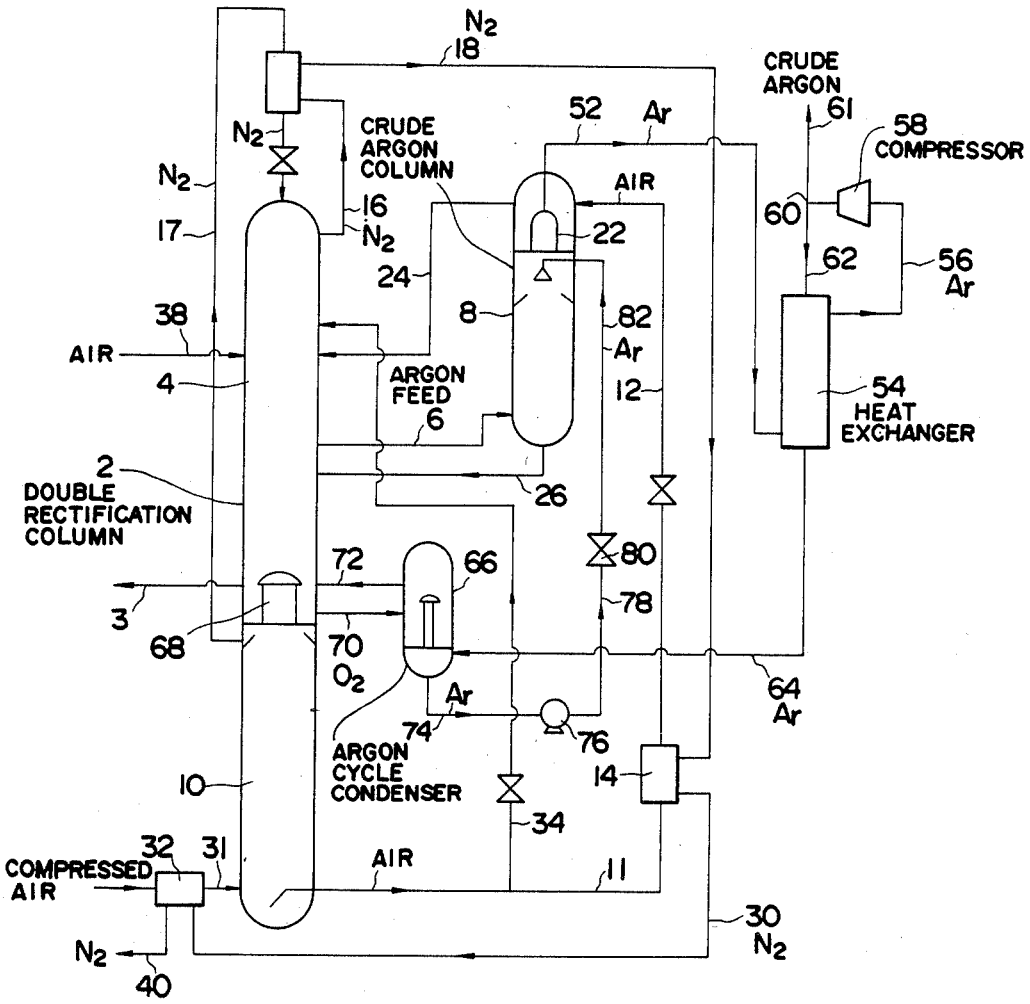
FIG. 3 is a flowsheet of a system to which the present invention is applied.

Referring to FIG. 3 there is illustrated an air separation plant to which the argon recovering process according to the present invention is applied. In FIG. 3 the like or similar members are designated by the same reference number as in FIGS. 1 and 2, and the description thereof is omitted.

Crude argon at the saturation temperature and at a pressure of 0.2 kg/cm$^2$G is extracted from the head of the crude argon column 8 through a conduit 52, and is then introduced to a heat exchanger 54 where it is heated to normal temperature. The heated crude argon is fed through a conduit 56 to a compressor 58 to be compressed to a pressure, e.g., about 1.5 kg/cm$^2$G (enough to evaporate liquid oxygen passed from a condenser 68 of the upper column 4 through a conduit 70 to an argon cycle condenser 66). Then, the compressed argon is bifurcated at a point 60. A larger part of the compressed argon passes through conduit 62 to the heat exchanger 54 where it is cooled to −175° C. by heat exchange with the argon gas fed from the conduit 52. Thereafter, the cooled argon is led via the conduit 64 to the argon cycle condenser 66. The remainder of the compressed argon gas is delivered through a conduit 61 to a well-known argon purifying process where pure argon is produced.

The argon cycle condenser 66 is connected to condenser 68 of the double rectifier 2 through conduits 70 and 72. The argon gas which has been introduced into the argon cycle condenser 66 through conduit 64 is liquefied by heat exchange with liquid oxygen fed through the conduit 70, and then passes through a conduit 74, pump 76 and conduit 78 to a valve 80 wherein it is expanded. Thereafter, the expanded argon is introduced as a reflux into the upper portion of the crude argon column 8 through a conduit 82, and facilitates the rectification for separation of feed argon. On the other hand the liquid oxygen which has been evaporated in the argon cycle condenser 66 by heat exchange with the argon gas is returned to the upper column 4 through conduit 72.

As apparent from the above description, an argon cycle is formed according to the present invention, the argon cycle including crude argon column 8, conduit 52, heat exchanger 54, conduit 56, compressor 58, conduit 62, heat exchanger 54, conduit 64, argon cycle condenser 66, conduit 74, pump 76, conduit 78, valve 80, conduit 82 and crude argon column 8.

When an increase in refrigeration to cool the crude argon column 8 is needed due to an increase in the argon feed gas, the present invention meets this need by increasing the amount of the crude argon circulating in the argon cycle to thereby increase the flow rate of the crude argon as the reflux fed to the crude argon column 8. Therefore the reflux in the crude argon column which must be almost proportionally increased with argon recovery increment can be controlled, not only without increment but also with reduction or even complete elimination of the liquid air fed from the sump of the lower column 10 to the condenser 22 of the crude argon column 8 and there occurs no increased deterioration of rectification in the upper column 4 due to the evaporated air from the condenser 22.

According to the present invention, crude argon is circulated in place of nitrogen, and the crude argon is hence compressed to a relatively low pressure, e.g. about 1.5 kg/cm$^2$G, sufficient for evaporating the liquid oxygen in the bottom of the upper column 4 while in the prior art nitrogen cycle process the cycling nitrogen is compressed to a pressure of 4 to 5 kg/cm$^2$G in the lower column 10. Thus, the present invention achieves a reduction in the cost of electric power consumed in the compressor 58.

Figure 4:
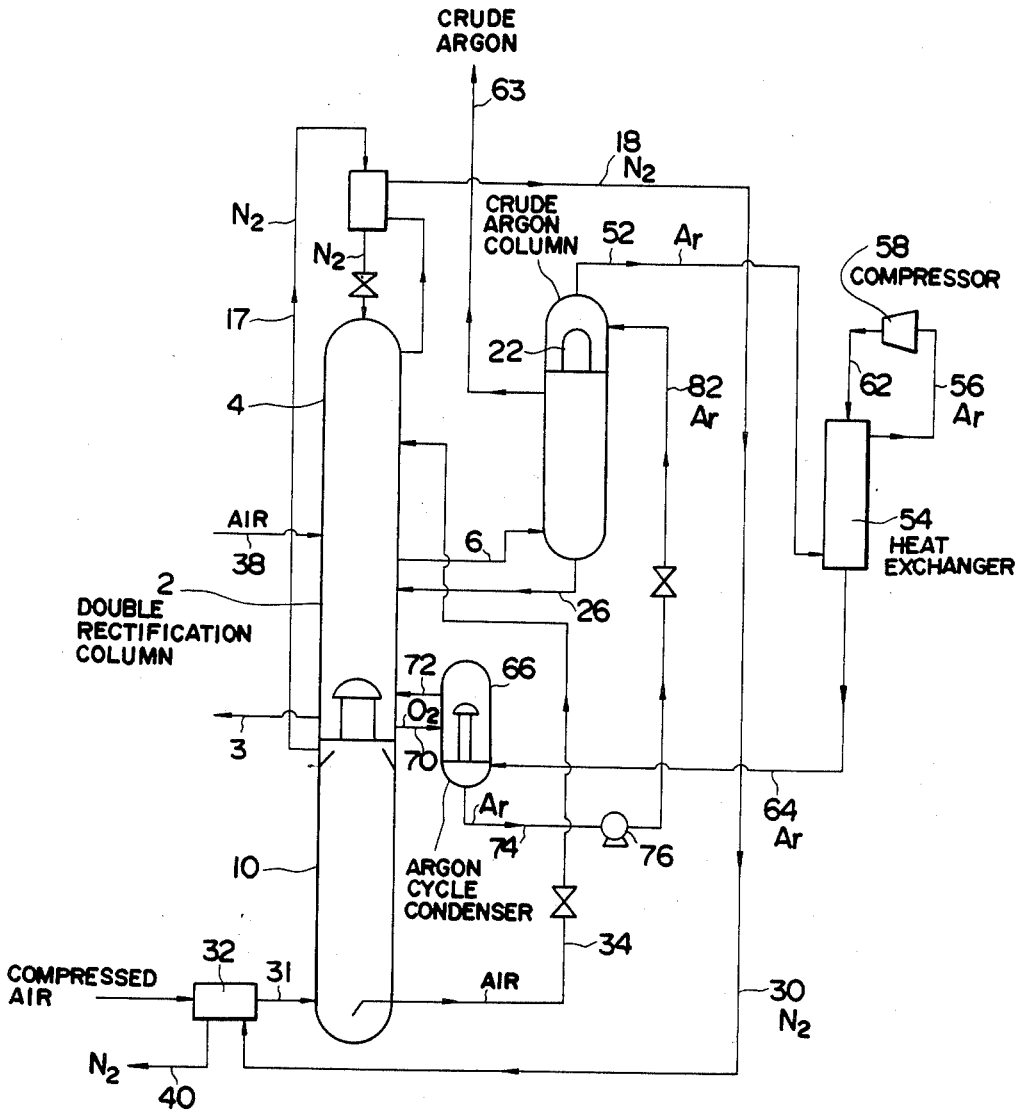
FIG. 4 is a flowsheet of a modified form of the system in FIG. 3.

In one modified form of the present invention shown in FIG. 4, the liquefied crude argon may be evaporated by cooling condenser-evaporator 22 at the upper portion of the crude argon column 8 so as to produce a reflux in the crude argon column without entering into the upper portion of the argon column 8 as the reflux as in the embodiment shown in FIG. 3, and the evaporated crude argon may be led to the heat exchanger 54. In this modification, a closed circuit is formed in which the crude argon leaving the compressor 58 is returned back to it in its entirety. The liquid air from the sump of lower column 10 to condenser 22 of crude argon column 8 is unnecessary for this modification.

EXAMPLE AND COMPARATIVE TESTS 1 AND 2

Figure 1:
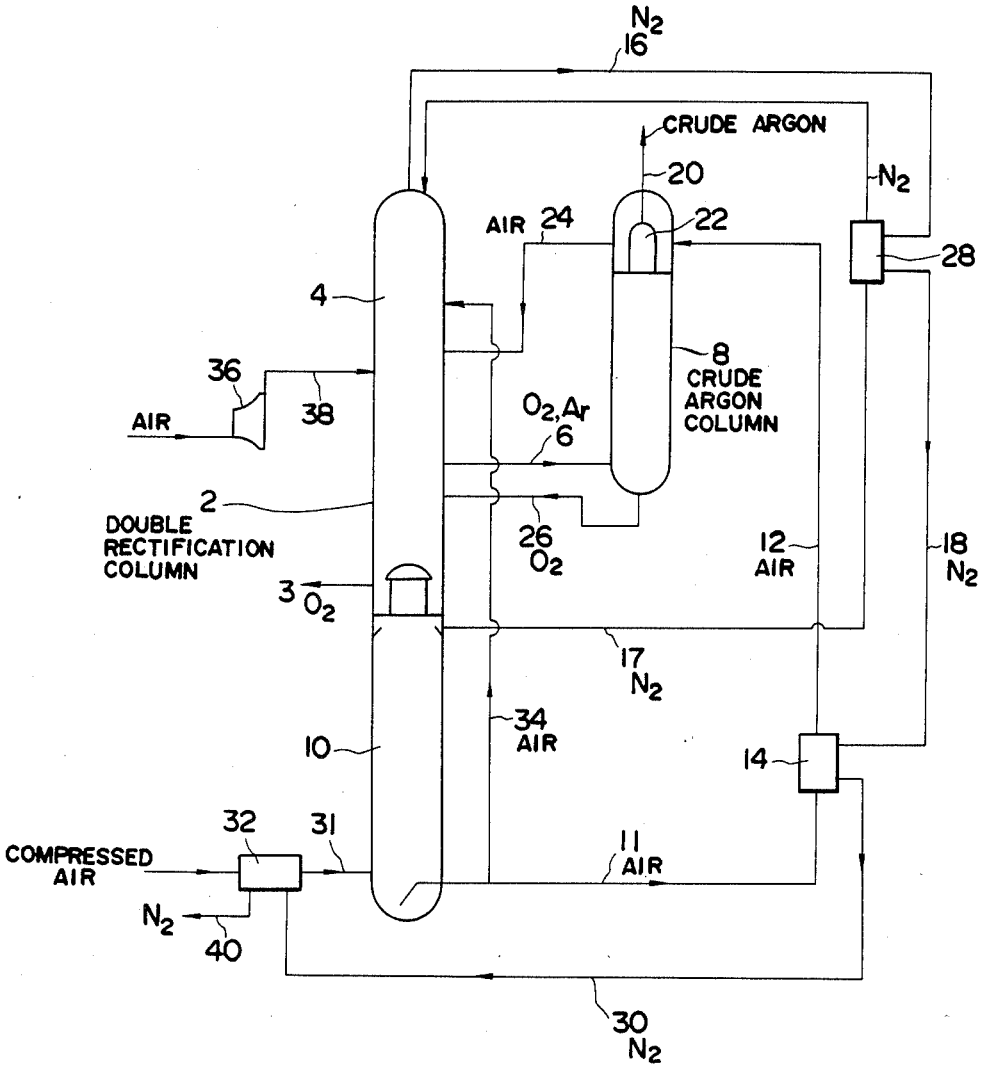
FIG. 1 PRIOR ART
FIG. 1 is a flowsheet of a typical example of the prior art argon recovering system.

A test (Example) was carried out using the air separation plant having the argon cycle shown in FIG. 3, and further comparative tests 1 and 2 were carried out adopting the air separation plant, shown in FIG. 1, without any auxiliary cycle and the air separation plant, shown in FIG. 2, having the nitrogen cycle respectively. Those three tests were conducted substantially on the same product conditions for oxygen and crude argon. The results are tabulated in the TABLE, in which the raw air refers to the air from which is removed carbon dioxide and moisture and which is then supplied to the lower column 10 through the conduit 31 at a temperature of about −170° C. Further, in the TABLE the oxygen gas refers to the oxygen gas issuing from the sump of the upper column 4 through a conduit 3 and the crude argon one issuing from the conduits 20 or 61. As is clearly seen from the TABLE, the present invention makes it possible to produce crude argon at a high yield with reduced electric consumption.

TABLE

| | Example (Present Invention) | Comparative Test 1 (Nitrogen Cycle) | Comparative Test 2 (No Auxiliary Cycle) |
|---|---|---|---|
| Amount of Raw Air (Nm$^3$/h) | 100,000 | 100,000 | 115,000 |
| Amount of Oxygen Gas (Nm$^3$/h) | 20,000 | 20,000 | 20,000 |
| Yield of Oxygen Gas | 0.96 | 0.96 | 0.83 |
| Amount of Crude Argon (Nm$^3$/h) | 700 | 700 | 700 |
| Yield of Crude Argon | 0.75 | 0.75 | 0.655 |
| Electric Power for Compression (kW) | | | |
| (a) of Raw Air | 8,150 | 8,150 | 9,400 |
| (b) in Auxiliary Cycle Unit | 550 | 850 | — |

TABLE-continued

| | Example (Present Invention) | Comparative Test 1 (Nitrogen Cycle) | Comparative Test 2 (No Auxiliary Cycle) |
|---|---|---|---|
| Total | 8,700 | 9,000 | 9,400 |

While the invention has been disclosed in specific detail for purposes of clarity and complete disclosure, the appended claims are intended to include within their meaning all modifications and changes that come within the true scope of the invention.

What is claimed is:

1. In a process for recovering argon in which a crude argon column is supplied with an argon feed gas containing a larger proportion of oxygen from a middle stage of an upper column of a double rectification column for low temperature air separation, the improvement comprising retrofitting an existing process to maximize argon recovery and minimize power consumption while precluding deterioration of rectification conditions in the upper column including the steps of:

(a) compressing argon gas to a pressure sufficient for evaporating liquid oxygen fed from a condenser of the double rectification column;

(b) precooling the compressed argon gas in a heat exchanger;

(c) liquefying the precooled argon gas by heat exchange with liquid oxygen from the condenser of the double rectification column;

(d) introducing the liquefied argon as a reflux into the head portion of the crude argon column thereby cooling said head portion and evaporating the liquefied argon; and (e) returning the evaporated argon to the step (a) for further compression to thereby circulate the argon gas.

2. A process for recovering argon as recited in claim 1, further comprising the steps of:

(f) before the compression step (a), introducing the argon gas issuing from the head of the crude argon column into the heat exchanger for precooling the compressed argon gas by heat exchange therewith;

(g) sending the argon gas, which is introduced into the heat exchanger and heat exchanged therein in the step (f), to the compressing step (a); and (h) subsequently to the compressing step (a), delivering part of the compressed argon gas for further purification thereof and the rest to the precooling step (b).

3. A process for recovering argon as recited in claim 2, further comprising the step of pumping the argon liquified in the step (c) to the cooling step (d).

* * * * *